US006448991B1

(12) United States Patent
Doan

(10) Patent No.: US 6,448,991 B1
(45) Date of Patent: Sep. 10, 2002

(54) COLOR PANEL IDENTIFICATION AND SYNCHRONIZATION IN A THERMAL PRINTER

(75) Inventor: Trung Dung Doan, Saint-Georges sur Loire (FR)

(73) Assignee: Z.I.H. Corp., Wilmington, DE (US)

( * ) Notice: Subject to any disclaimer, the term of this patent is extended or adjusted under 35 U.S.C. 154(b) by 0 days.

(21) Appl. No.: 09/841,918

(22) Filed: Apr. 24, 2001

(51) Int. Cl.[7] ..... B41J 35/18
(52) U.S. Cl. ..... 347/178
(58) Field of Search ..... 347/177, 178, 347/217; 400/237, 240.3, 242.4, 247

(56) References Cited

U.S. PATENT DOCUMENTS 4,710,781 A 12/1987 Stephenson
5,739,835 A 4/1998 Morgavi et al.
5,755,519 A 5/1998 Klinefelter

FOREIGN PATENT DOCUMENTS

JP 61-177275 * 8/1986

* cited by examiner

*Primary Examiner*—Huan Tran
(74) *Attorney, Agent, or Firm*—Fulbright & Jaworski LLP

(57) ABSTRACT

A device adapted to recognize a color dye frame from a color ribbon (for use in a thermal printer) comprises a LED (light emitting diode) capable of producing white light, positioned so that the ribbon passes between the LED and a photo-transistor. The photo-transistor collects the light emitted by the LED as it passes through the color dye frame and generate a specific exit voltage associated with the color of the dye frame. An analog to digital converter transforms the voltage into a digital signal which is fed into a micro-computer. The micro-computer processes the digital signal by comparing the digital signal to a stored set of values associated with each color dye frame.

21 Claims, 2 Drawing Sheets

COLOR PANEL IDENTIFICATION AND SYNCHRONIZATION IN A THERMAL PRINTER

FIELD OF THE INVENTION

The invention pertains to a color sensor system to identify and synchronize the color panels of an ink ribbon loaded in a thermal printer. The color sensor system can detect any specific color panel and synchronize the first color frame to be printed while wasting as few ribbon frames as possible. More particularly it pertains to a novel panel identification solution for a quicker and more cost effective technology.

BRIEF DESCRIPTION OF RELATED ART

In the field of printer technology, a number of different methods have been developed for applying ink to paper, plastic cards or other print media in a controlled manner. One of the most common methods is through the use of ink ribbons. A flexible ribbon-shaped substrate is impregnated or coated with an ink that adheres to paper or a plastic card. The act of printing depletes the print substance so that the substrate must periodically be replaced. The use of replaceable ribbons, supply spools, and take-up spools is therefore common in many different types of printers.

In one type of thermal printer which prints colored images, a carrier contains a repeating series of spaced frames of different colored heat transferable dyes. In such an apparatus, the carrier is disposed between a receiver, such as coated paper, and a print head formed of, for example, a plurality of individual heating elements. When a particular heating element is energized, it is heated and causes dye from the carrier to transfer to the receiver. The density or darkness of the printed color dye is a function of the energy delivered from the heating element to the carrier.

Thermal dye transfer printers offer the advantage of true "continuous tone" dye density transfer. This result is obtained by varying the energy applied to each heating element, yielding a variable dye density image pixel on the receiver.

The carrier often includes a repeating series of spaced yellow, magenta, and cyan dye frames. The carrier may also include a varnish frame to protect the color from UV rays and protect against abrasion and a black frame.

First, the yellow frame and the receiver are moved until they are positioned under the print head and as they are advanced, the heating elements are selectively energized to form a row of yellow image pixels on the receiver. This process is repeated until a yellow dye image is formed in the receiver. Next, the magenta frame is moved under the print head and the receiver is also moved under the print head. Both the receiver and the magenta frame are moved as the heating elements are selectively energized and a magenta image is formed superimposed upon the yellow image. Finally, as the cyan dye frame and the receiver are moved under the print head, the heating elements are selectively energized and a cyan dye image is formed in the receiver superimposed upon the yellow and magenta dye images. These yellow, magenta and cyan dye images combine to form a colored image.

Since the carrier has a repeating series of yellow, magenta and cyan dye frames, it is important to identify the leading yellow frame of each series (See FIG. 2). One way to identify the leading yellow frame is to employ a conventional sensitometer. The sensitometer identifies a yellow dye frame by producing a particular analog signal in response to light passing through the yellow dye frame. A sensitometer is effective but can be complex and expensive to implement in a printer.

Another way to identify a yellow dye frame is by a code field. A code field is composed of a series of spaced black bars disposed in a clear interframe area between each dye frame. This code field can identify the particular color of the following frame. A reader station can be provided which includes a plurality of photodetectors which are aligned to produce a particular output signal representing the color of the following dye frame. Such a system can perform quite satisfactorily but requires decoding electronics and involves additional manufacturing steps for forming each code field in the clear interframe areas of the carrier.

A third way to identify the color of each dye frame is by using a red light source that provides two logical levels representing only two "colors" which are: transparent (for yellow, magenta, varnish, etc) and dark (for cyan, black, etc). This solution often requires a wheel with holes and an optical sensor to calculate the distance to move the film to align the yellow frame with the print head.

A fourth way to identify the color of each dye frame is by using both a yellow and a red light source transmitted through each dye frame. The problem with this method is that the method fails to detect a difference between the yellow dye frame and the varnish dye frame and also fails to detect a difference between the cyan dye frame and the black dye frame. The logical levels of this method are as follows:

| Frame | Yellow Light | Logical Level | Red Light | Logical Level |
|---|---|---|---|---|
| Yellow | Transmits | 1 | Transmits | 1 |
| Varnish | Transmits | 1 | Transmits | 1 |
| Magenta | Blocked | 0 | Transmits | 1 |
| Cyan | Blocked | 0 | Blocked | 0 |
| Black | Blocked | 0 | Blocked | 0 |

A fifth way to identify the color of each dye frame is by using a black bar mark located at the beginning of the yellow dye frame. This solution needs an infra-red sensor to detect the black bar mark, a wheel with holes and an optical sensor to calculate the distance to the film must move to synchronize the other dye frames with the print head. This solution represents an expensive technology. What is needed is a cost effective technology that is capable of detecting the actual color of each dye frame without the use of a code system on the ribbon itself or in a clear interframe area between each dye frame.

SUMMARY OF THE INVENTION

The invention pertains to a device capable of recognizing any color dye frame from a color ribbon for use in a thermal printer. The device comprises a LED (light emitting diode) capable of producing white light, positioned so that the ribbon passes between the LED and a photo-transistor. The photo-transistor collects the light emitted by the LED as it passes through the color dye frame and generates a specific exit voltage associated with the color of the dye frame. An analog-to-digital converter (ADC) transforms the exit voltage into a digital signal and a micro-computer processes the digital signal and compares the digital signal to a stored set of values associated with each color dye frame.

Because ribbon having color dye frames (panels) is always organized according to a specific sequence, e.g., yellow, magenta, cyan, black, the ribbon can be automatically driven and synchronized so that once the first yellow dye frame is aligned with the print head, all subsequent dye frames will also be aligned with the print head.

The foregoing and additional features and advantages of the present invention will become apparent by way of non-limitative examples shown in the accompanying drawings and the detailed description that follows. In the figures and written description, numerals indicate the various features of the invention, like numerals referring to like features throughout both the drawings and the written description.

BRIEF DESCRIPTION OF THE DRAWINGS

The invention is shown by way of example in the accompanying drawings in which.

DETAILED DESCRIPTION OF THE PREFERRED EMBODIMENT

Figure 3:
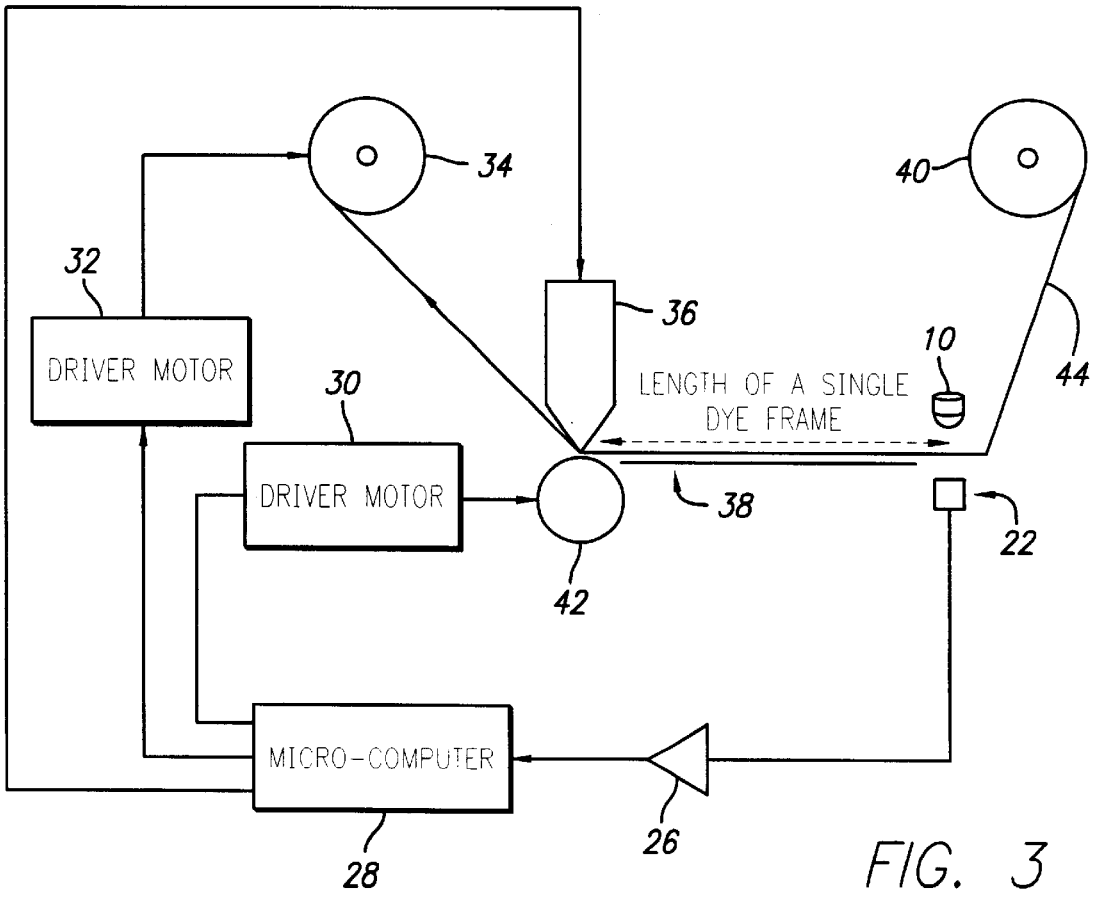
FIG. 3 is a schematic of a thermal printing system in accordance with the present invention.

The invention pertains to a device adapted to recognize color dye frame (panel) from a color ribbon for use in a thermal printer. The device comprises a LED (light emitting diode) 10 capable of producing white light, positioned so that the ribbon passes under the LED; a photo-transistor 22 positioned under the ribbon and adapted to collect the light emitted by LED 10 as it passes through the color dye frame, and further adapted to generate a specific exit voltage associated with the color of the dye frame; an analog-to-digital converter (ADC) 26 to transform the voltage into digital signal; and a micro-computer 28 to process the digital signal and associate the digital signal a color dye frame. (FIG. 3).

The LED and the photo-transistor used in this invention are commercially available, inexpensive and have a long life span. Another advantage of the present invention is that the ribbon type can be identified as a panel sequence as the ribbon passes through the device.

The sequence of color dye frames are repeated along the ribbon. In one example, each sequence contains the following color dye frames: yellow 12, magenta 14, cyan 16, black 18, and varnish 20.

Figure 1:
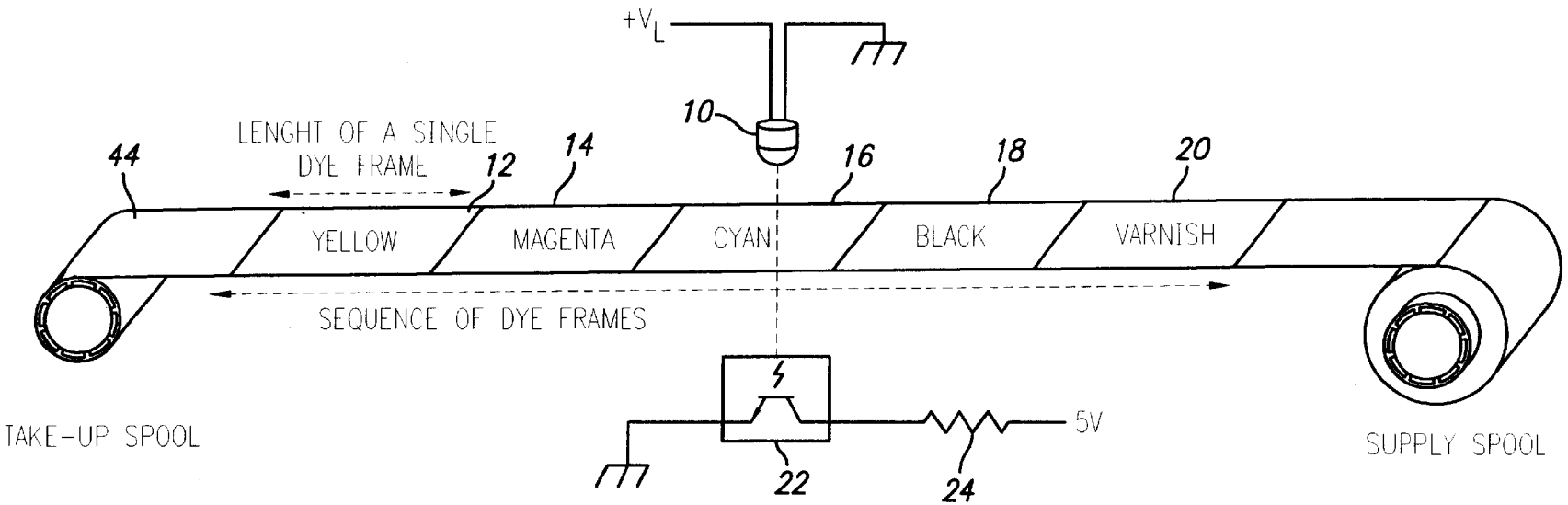
FIG. 1 is a perspective view of the preferred embodiment of the present invention.

Disposed perpendicular to the ribbon's surface is LED 10, capable of producing white light, that may be based of InGaN (Indium Gallium Nitride). (See FIG. 1). The light from LED 10 crosses a colored dye frame (panel) on the ribbon and produces a light having a wave length corresponding to the color of the panel. This light is then detected by photo-transistor 22.

Figure 2:
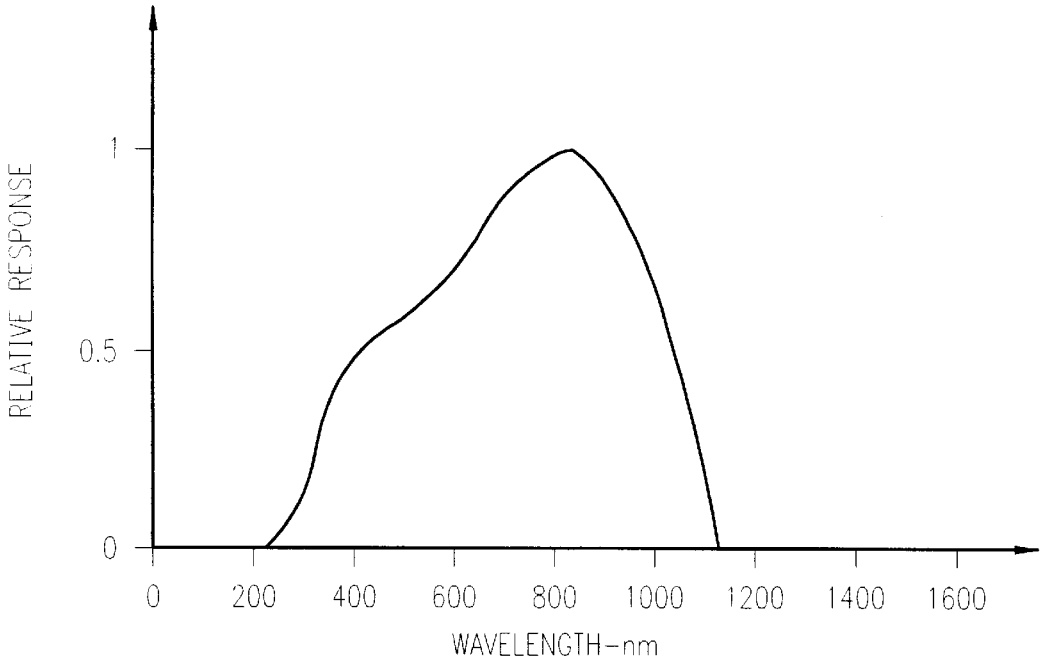
FIG. 2 is a graph of spectral phototransistor responsivity in accordance with the present invention.

In one example, the maximum light intensity of LED 10 is 420 mCd. The diffusion angle of LED 10 depends on the distance between LED 10 and the receptor of photo-transistor 22. In the preferred embodiment, the diffusion angle is at least 35 degrees and photo-transistor 22 has an acceptance angle of at least 50 degrees and a light sensitivity which is approximately linear for wavelengths of 300 nm to 900 nm. (FIG. 2).

A resistor 24 (FIG. 1) is coupled between the collector of photo-transistor 22 and a reference potential of 5 Volts whereby photo-transistor 22 produces an exit voltage according to the color dye frame detected. The following table represents the exit voltage of each color dye frame detected:

| Color of the ribbon | Voltage of the phototransistor |
|---|---|
| Yellow | 1 Volts |
| Magenta | 2.5 Volts |
| Cyan | 3.5 Volts |
| Black | 4.5 Volts |
| Varnish | 0 Volts |

The detection system described above is integrated in a thermal printing system. (FIG. 3). The voltage from photo-transistor 22 is an analog value that is converted into a digital value by ADC 26 which, preferably, has a variable analog voltage range from 0 to 5V for a range of digital values $2^8$ (from 0 to 255). The relationship between digital value and analog voltage can be described by the following formula:

$$\text{Voltage}=5\text{Volts}\cdot\text{digital value}/(2^8)$$

The present invention detects the transition between a current dye frame and a subsequent dye frame. The suite of voltages are recognized so that micro-computer 28 knows which dye frame on ribbon 44 is being detected and stops the rotation of drive motor 32.

The distance between photo-transistor 22 and the print head 36 is equivalent to the length of one dye frame (panel) (FIG. 3) so that when a transition between one dye frame and another is being detected, the beginning of the current dye frame is under the print head, ready to execute the printing command.

When a print command is sent by the operator to micro-computer 28 and the yellow dye frame is not under the print head, ribbon 44 will be fed off a supply spool 40 and be driven until photo-transistor 22 detects the transition between the yellow and magenta dye frames (from 1 V to 2.5V). When photo-detector 22 detects the transition between the yellow and magenta dye frames, print head 36 can begin printing yellow onto media 38. (FIG. 3)

When yellow panel 12 is finished printing, the ribbon 44 is driven until the photo-transistor 22 detects the transition of the magenta 14 and cyan 16 panels (from 2.5V to 3.5V) and then print head 36 begins printing magenta onto media 38.

When the magenta panel 14 is finished printing, the ribbon 44 is driven until photo-transistor 22 detects the transition of the cyan and black panels (from 3.5V to 4.5V) and then print head 36 begins printing cyan onto media 38.

When the cyan panel 16 is finished printing, the ribbon 44 is driven until photo-transistor 22 detects the transition of the black and varnish panels (from 4.5V to 0V) and then print head 36 begins printing black onto media 38.

When the black panel 18 is finished printing, the ribbon 44 is driven until photo-transistor 22 detects the transition of the varnish and yellow panels (from 0V to 1V) and then print head 36 begins printing varnish onto media 38.

When the varnish panel 20 is finished printing, the ribbon 44 is driven until photo-transistor 22 detects the transition of the yellow and magenta panels (from 1V to 2.5V) and then the yellow panel 12 is ready for the next printing operation. A new cycle can start again when a printing command is sent to the micro-computer.

During the printing micro-computer 28 controls the roll up of ribbon 44 by take-up spool 34 (FIG. 3) and driver motor 32 (FIG. 3); the energy provided for each heating element of print head 36 to transfer the color from the dye frame on to media 38; and the driving of media 38 with the use of driver motor 30. Micro-computer 28 receives the digital signal from ADC 26.

While certain exemplary embodiments have been described in detail and shown in the accompanying drawings, it is to be understood that such embodiments are merely illustrative of and not restrictive on the broad invention, and that this invention is not to be limited to the specific arrangements and constructions shown and described, since various other modifications may occur to those with ordinary skill in the art.

I claim:

1. A colored dye frame detection device, comprising:

an LED adapted to produce white light, the LED being disposed adjacent to a ribbon to illuminate a repeating sequence of colored dye frames on the ribbon; and a photo-detector having a collector, the photo-detector being disposed adjacent to a ribbon and opposite the LED and adapted to detect the intensity of the light from the LED after the light passes through a dye frame, the photo-detector being further adapted to provide an output voltage in proportion to the intensity of the light passing through a dye frame.

2. The device of claim 1, further comprising an analog to digital converter (ADC) operatively coupled between the photo-detector and a micro-computer for converting the output voltage into a digital signal to be processed by the micro-computer.

3. The device of claim 2, the micro-computer being capable of discerning the colors yellow, magenta, cyan, black, and varnish.

4. The device of claim 1, further comprising a resistor operatively coupled between the collector of the photo-detector and a reference voltage source.

5. The device of claim 1, further comprising printing means disposed adjacent the ribbon and away from the photo-detector at a distance equal to the length of a single dye frame.

6. The device of claim 2, wherein the ADC is adapted to output 256 digital values.

7. A color panel identification system comprise:

at least one white light emitting LED adapted to illuminate a color panel on a ribbon;

at least one photo-detector adapted to collect LED light passing through said color panel and output a corresponding voltage signal;

at least one analog-to-digital converter (ADC) operatively coupled to said at least one photo-detector to receive said voltage signal and generate a corresponding digital signal; and at least one micro-computer operatively coupled to said at least one ADC to process said digital signal for color panel identification.

8. The color panel identification system of claim 7, wherein said at least one photo-detector comprises at least one photo-transistor having at least one collector.

9. The color panel identification system of claim 8, further comprising at least one resistor operatively coupled between said at least one collector and at least one reference voltage source.

10. The color panel identification system of claim 7, further comprising at least one printing means disposed adjacent the ribbon and away from said at least one photo-detector at a distance equal to the length of a single color panel.

11. A color panel recognition system comprising:

at least one white light source adapted to illuminate a color panel on a ribbon;

at least one photo-detection means disposed opposite said at least one white light source and adapted to collect light passing through said color panel and generate a corresponding output signal; and at least one resistor electrically coupled between said at least one photo-detection means and at least one reference voltage source.

12. The color panel recognition system of claim 11, further comprising at least one signal computing means operatively coupled to said at least one photo-detection means to process said output signal for color panel recognition.

13. The color panel recognition system of claim 12, wherein said at lest one white light source is at least one light emitting diode (LED) adapted to produce white light.

14. The color panel recognition system of claim 13, wherein said at least one photo-detection means includes at least one photo-transistor having at least one collector being electrically coupled to said at least one resistor.

15. The color panel recognition system of claim 14, wherein said at least one photo-detection means further includes at least one analog-to-digital converter (ADC) operatively coupled to said at least one photo-transistor.

16. The color panel recognition system of claim 15, wherein said at least one ADC is adapted to output 256 digital values.

17. The color panel recognition system of claim 15, wherein said at least one signal computing means includes at least one micro-computer operatively coupled to said at least one ADC.

18. A color panel ribbon identification and synchronization system for use in a printer, said system comprising:

(a) a white light emitting LED adapted to illuminate a series of color panels on a driven ribbon;

(b) a photo-transistor adapted to collect LED light passing through each color panel and output a corresponding voltage signal, said photo-transistor having a collector;

(c) a printhead disposed adjacent the driven ribbon and away from the photo-transistor at a distance equal to the length of a single color panel;

(d) a resistor electrically coupled between said collector and a reference voltage source;

(e) an analog-to-digital converter (ADC) operatively coupled to said photo-transistor to receive said voltage signal and generate a corresponding digital signal; and (f) a micro-computer operatively coupled to said ADC to process said digital signal for color panel ribbon identification and synchronization.

19. The system of claim 18, further comprising means for driving said ribbon.

20. The system of claim 19, wherein said micro-computer is adapted to control said ribbon driving means during operation of the printer.

21. The system of claim 20, wherein said ADC is adapted to output 256 digital values.

* * * * *

UNITED STATES PATENT AND TRADEMARK OFFICE

CERTIFICATE OF CORRECTION

PATENT NO. : 6,448,991 B1 
DATED : September 10, 2002
INVENTOR(S) : Trung Dung Doan It is certified that error appears in the above-identified patent and that said Letters Patent is hereby corrected as shown below:

Title page,
Item [73], Assignee, should read:

-- [73] Assignee: ZIH Corp., a Delaware Corporation with it's principal office in Hamilton, Bermuda. --

Signed and Sealed this

Sixteenth Day of December, 2003

JAMES E. ROGAN
*Director of the United States Patent and Trademark Office*